US005101512A

United States Patent [19]

Weinstein

[11] Patent Number: 5,101,512

[45] Date of Patent: Apr. 7, 1992

[54] DISPOSABLE WATER IMPERMEABLE TRANSPARENT PERSONAL BODY COVER

[76] Inventor: Carol Weinstein, 60 Sutton Pl. S., Ste. 4A North, New York, N.Y. 10022

[21] Appl. No.: 458,399

[22] Filed: Dec. 28, 1989

[51] Int. Cl.[5] ..... A41D 3/00

[52] U.S. Cl. ..... 2/84; 2/87; 2/174; 2/202; D2/510

[58] Field of Search ..... 2/84, 87, 88, 171, 198, 2/202, 206, 207, 174; D2/510, 511

[56] References Cited

U.S. PATENT DOCUMENTS

| | | | |
|---|---|---|---|
| 396,809 | 1/1889 | Cochran | 2/171 |
| 1,081,154 | 12/1913 | Saltz | 2/207 |
| 1,186,703 | 6/1916 | Sullivan | 2/202 |
| 1,483,226 | 2/1924 | Johnson | D2/510 |
| 1,996,367 | 4/1935 | Davis | 2/174 |
| 2,105,956 | 1/1938 | Schnaittacher | D2/510 |
| 2,295,279 | 9/1942 | Andrews | D2/510 |
| 2,368,272 | 1/1945 | Sydenham | 2/84 |
| 2,412,415 | 12/1946 | Navon | 2/84 |
| 2,856,607 | 10/1958 | Richardson | D2/510 |
| 3,014,218 | 12/1961 | Smith | 2/84 |
| 3,145,393 | 8/1964 | Mufich | 2/202 |
| 3,458,864 | 8/1969 | Austin | 2/202 |
| 3,505,678 | 4/1970 | Key | 2/174 |
| 3,755,819 | 9/1973 | Douglas | D2/510 |
| 3,951,160 | 4/1976 | Nitu | 2/84 |
| 3,983,580 | 10/1976 | Zeiber | 2/202 |
| 4,055,852 | 11/1977 | Wallace | 2/84 |
| 4,285,068 | 8/1981 | Ross | 2/202 |
| 4,457,027 | 7/1984 | Gladstone | 2/174 |
| 4,541,128 | 9/1985 | Will | 2/84 |
| 4,554,683 | 11/1985 | Wong | 2/202 |
| 4,589,408 | 5/1986 | Singer | 2/205 |
| 4,698,853 | 10/1987 | Walton | 2/174 |
| 4,722,100 | 2/1988 | Greer | 2/174 |
| 4,887,316 | 12/1989 | Morandini | 2/174 |

FOREIGN PATENT DOCUMENTS

| | | | |
|---|---|---|---|
| 1144702 | 4/1983 | Canada | 2/202 |
| 781682 | 5/1935 | France | 2/198 |
| 2582195 | 11/1986 | France | 2/87 |
| 330681 | 7/1958 | Switzerland | 2/206 |
| 194222 | 3/1923 | United Kingdom | 2/87 |
| 1249978 | 10/1971 | United Kingdom | 2/84 |

OTHER PUBLICATIONS

Woodward & Lothrop Catalogue, Spring 1958, p. 15.

*Primary Examiner*—Werner H. Schroeder
*Assistant Examiner*—Diana Biefeld
*Attorney, Agent, or Firm*—Dilworth & Barrese

[57] ABSTRACT

A disposable water impermeable garment which may be constructed according to various embodiments to provide protection to the head, selected portions of the human body, as well as objects being carried by the user. The cover is constructed of water impermeable transparent sheet material transparent at least over a portion corresponding to the lines of sight of the user, and having perforations to provide ventilation to the user. An endless elastic band—or other type of band—is tensioned about the cover and the head or slipped loosely around the neck of the user to retain the sheet material in position about the head of the user. In one embodiment the band is not endless and is capable of having both ends connected during use as by tying or fastening both ends.

28 Claims, 2 Drawing Sheets

FIG. 5
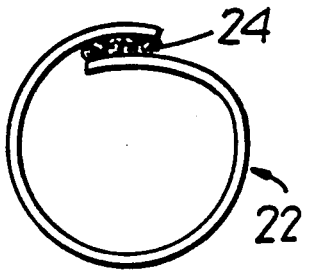
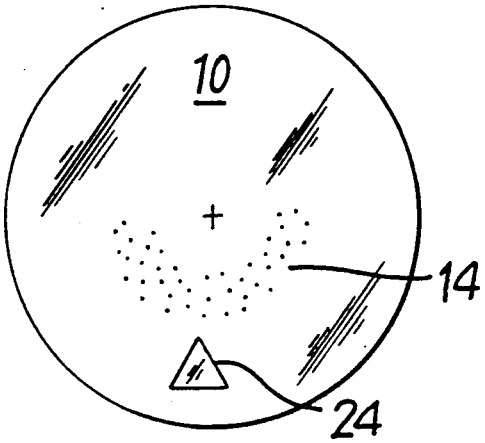
FIG. 7
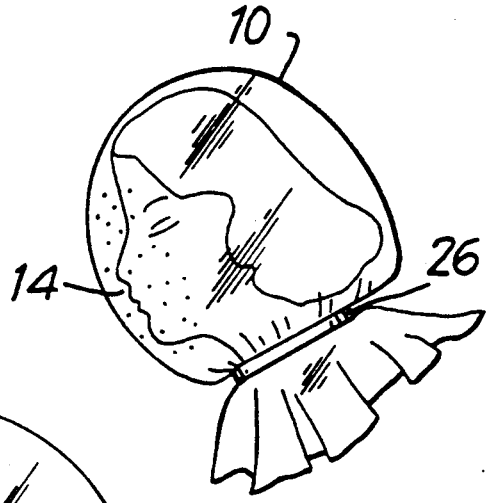
FIG. 6
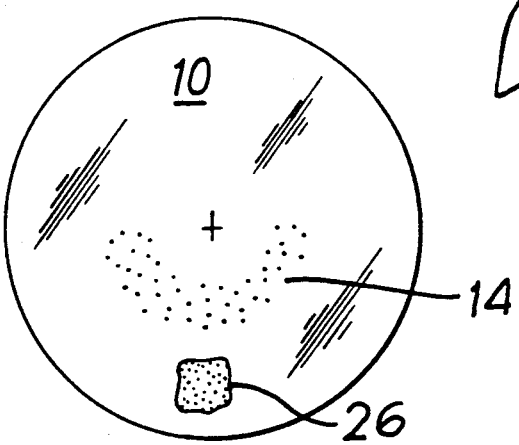
FIG. 8

DISPOSABLE WATER IMPERMEABLE TRANSPARENT PERSONAL BODY COVER

BACKGROUND OF THE INVENTION

1. Field of the Invention

The present invention relates to a protective body covering. In particular, the invention relates to a disposable, water impermeable covering which provides protection to the head, selected portions of the human body and objects being carried by the user.

2. Description of the Related Art

Various types of protective head and body coverings are available. Some of these coverings are disposable and are used while trying on clothing to protect garments from make-up, hair spray, powder, earrings or the like. Other coverings are not disposable and are worn to protect the body from rain, inclement weather, dust, straw, smoke or toxic or noxious gases.

One disadvantage of existing head coverings is that they do not combine ready wear features with disposability and low cost. For example, a desirable disposable head cover will be almost instantly placed and held on the head with a minimum of complicated devices for holding the cover in position. Further, in many instances, such covers do not offer capability to protect parts of the body and objects carried by the user. Also, such covers are generally not intended for use in rain or inclement weather.

During inclement weather, a raincoat may be used, but an additional covering is often needed for the hair or head and the face will generally not be covered. In addition, packages or objects carried by the user are not protected. A rain poncho or similar garment can also be worn, but the user's face will not be protected. Note also, that such existing covers are not contemplated as disposable items.

To date, a disposable head cover which may be readily worn by the user and which may be constructed to cover selected portions of the body as well as objects carried by the user, has yet been devised. I have invented such a disposable cover which may be constructed in different sizes to cover selected portions of the body without deviating from the basic construction

SUMMARY OF THE INVENTION

A disposable body protective garment which comprises a sheet of water impermeable material dimensioned and configured to drape over a user's head, the material being transparent at least over a portion corresponding to the lines of sight of the user, and means dimensioned and adapted to encircle the sheet of material and an adjacent body portion to retain said sheet of water impermeable material in position thereon In one preferred embodiment, the disposable body protective garment comprises a sheet of substantially water impermeable material dimensioned and configured to be draped over a user's head, the material being transparent at least over a portion corresponding to the lines of sight of the user, and means dimensioned and adapted to encircle and to be tensioned about the user's head to retain the sheet of water impermeable material in position thereon.

In the preferred embodiment a cover is disclosed for protecting an upper portion of the human body which comprises a sheet of substantially water impermeable material having a plurality of apertures selectively positioned such that when the sheet is positioned over the The sheet is transparent at least in selected areas corresponding to lines of sight of the user sufficient to provide visibility to the user. The invention further comprises means positionable about the sheet and the user's head for retaining the cover in position thereon The cover according to the invention preferably includes a sheet material of polymeric material Preferably the polymeric material is a transparent flexible plastic material such as polyethylene or polyvinylchloride. The retaining means is dimensioned to be positioned about the head of the user. Further, the sheet material is disposable.

In one preferred embodiment the retaining means is an endless elastic band dimensioned to be positioned and tensioned about the sheet and the head of the user to retain the sheet in position. According to an alternative embodiment, the retaining means is a separable fastener of the hook and loop-type.

In one embodiment the sheet is dimensioned and configured to extend over the user's head and shoulder area. In another embodiment the sheet is dimensioned and configured to extend over the user's head, shoulders and upper body portion In still another embodiment the sheet is dimensioned and configured to extend entirely over the user's body. The thickness of the plastic material of the sheet ranges broadly from about 0.3 to about 10 mil and preferably from about 0.5 to about 1 mill. Further, the sheet material may be a fibrous material such as paper having at least a transparent portion corresponding to the lines of sight of the user.

In the preferred embodiment means such as a "V" shaped notch is provided in the sheet material to distinguish the front of the sheet material to facilitate alignment of the apertures with the lines of sight of the user. The "V" shaped notch is generally provided in the sheet material at a preselected location, such as the front of the sheet material. A decal may also be provided on the sheet material at a preselected location. Further, the means to distinguish the front of the sheet material may be a patch of material provided thereon at a preselected location. The patch may have a surface sufficiently rough to assist the user to determine the front of said sheet material by touch and feel.

In a specific embodiment as disclosed herein, the sheet is dimensioned to be draped over the user's head and neck area and retaining means is provided to encircle the sheet of material and the user's neck loosely, but sufficient to retain the sheet of water impermeable material in position thereon. The retaining means may be an endless band or it may be a ribbon-type band having two end portions which can be tied together.

BRIEF DESCRIPTION OF THE DRAWINGS

Preferred embodiments of the invention are described hereinbelow with reference to the drawings wherein:

FIG. 5 is a view of an alternative headband to secure the cover on the user's head; and FIG. 6 is a view of an alternative embodiment of the invention.

FIG. 7 is a view similar to FIG. 1, illustrating another alternative embodiment incorporating a decal to distinguish the front side; and FIg. 8 is a view of still another alternative embodiment, incorporating a rough patch to assist the user in identifying the front side.

DESCRIPTION OF THE PREFERRED EMBODIMENTS

Referring to FIG. 1, FIG. 2, FIG. 3 and FIG. 4, there is shown various embodiments of a disposable cover 10 constructed according to the present invention for protecting a portion of the human body and objects being carried by the user. The disposable cover is in the form of a generally circular sheet 10 of a substantially water impermeable material and is transparent in at least selective areas corresponding to the lines of sight of the user sufficient to provide normal visibility to the user.

Figure 1:
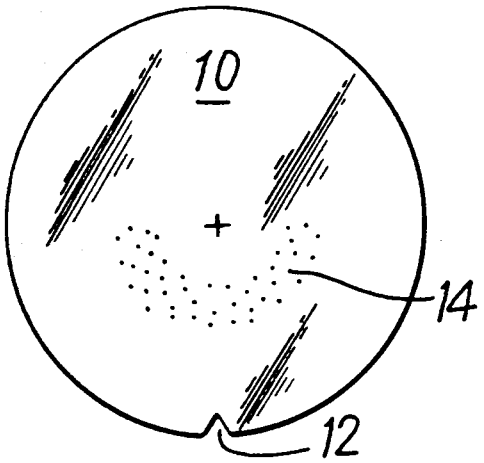
FIG. 1 is a view of a disposable cover constructed according to the present invention in a fully unfolded condition.

As seen in FIG. 1, the sheet 10 has a continuous and uninterrupted periphery over substantially the entire extent thereof, with the exception of "V" shaped notch 12 which will be described in further detail herein below. In the preferred embodiment the entire cover is transparent.

Figure 2:
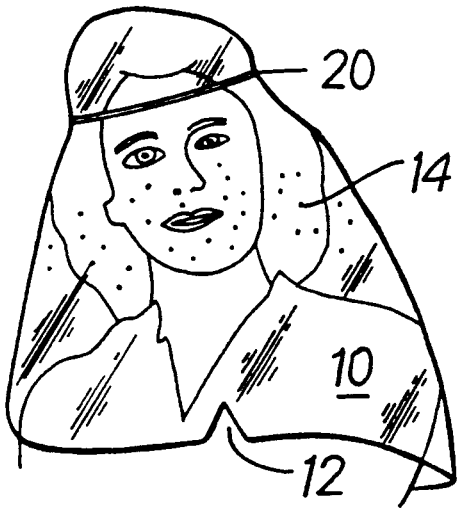
FIG. 2 is a view of a small size disposable cover constructed according to the present invention which extends over the user's head and shoulder area.
Figure 3:
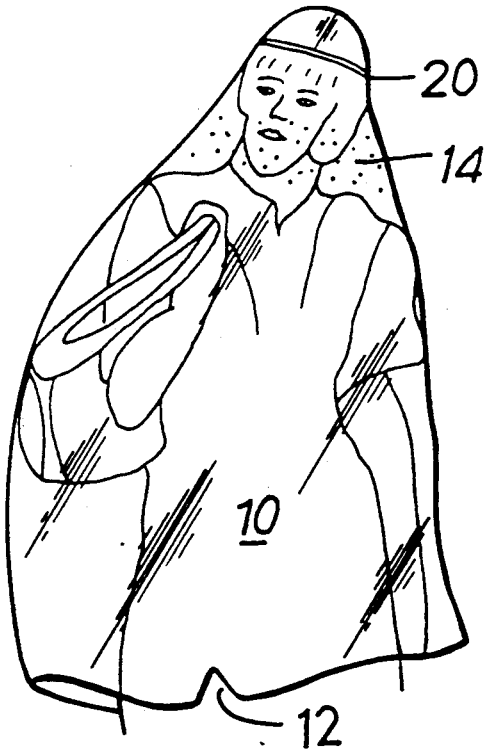
FIG. 3 is a view of a second size disposable cover constructed according to the present invention which extends over the user's head, shoulders and mid body portion.
Figure 4:
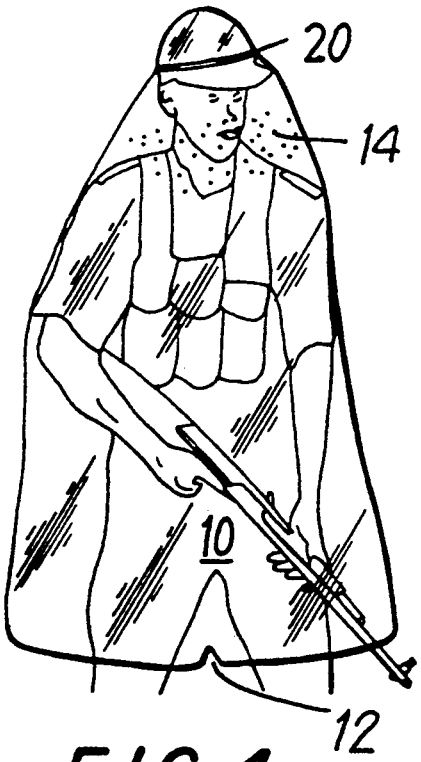
FIG. 4 is a view of a third size disposable cover according to the present invention which extends substantially over the user's body as a full size coat.

The disposable cover shown in FIG. 2 is dimensioned and configured to protect the head and shoulders of the user. The disposable covers shown in FIGS. 3 and 4 are dimensioned and configured to protect the user as well as objects being carried by the user. Protection is provided from inclement weather conditions such as rain, snow, etc., while covering the user's face. The cover may of course, also be used to protect the user from environmental conditions not related to weather conditions, such as industrial areas in which water or other liquids are being sprayed.

The cover is perforated as shown to permit air to pass through and provide ventilation for the user. A plurality of perforations 14 are provided in the area adjacent the user's face. Each perforation is of minimum size which is capable of permitting air to pass therethrough but does not permit the average size raindrop from passing therethrough at least over a predetermined amount of time It is generally known that any liquid will eventually seep through an aperture in a layer of such plastic material. However, in the present instance, the cover is constructed of a material which is of a predetermined thickness and flexibility and which permits the provision of perforations which will not normally permit water to penetrate them over a time period which this body cover will normally be used, i.e., relatively short periods of time and on a throwaway basis.

The disposable cover is substantially water impermeable and can be made of a flexible plastic such as polyethylene or polyvinylchloride. The plastic must be thin enough so that it is flexible and the user is free to move about; yet, the plastic must be sufficiently thick such that it does not tend to adhere or stick to the user due to static charges or the like. To provide maximum comfort and efficiency to the user, the thickness of the material should be in the range of about 0.3 mil to about 10 mil, i.e., about 0.0003 inches to about 0.01 inches. More preferably the thickness is from about 0.5 mil to about 1 mil (i.e., about 0.0005 inches to about 0.001 inches). Other materials contemplated within the scope of the invention include materials which are rendered water impermeable by coating with a waterproofing agent. The cover can therefore also be constructed of a waterproofed fiber material such as transparent paper.

In the preferred embodiment, the front of the cover 10 is distinguished to avoid confusion as to the location of the perforations 14 when the cover is placed on the user's head. This is significant to make certain that the perforations 14 are located in front of the nose and mouth of the user. For example, if the cover is worn incorrectly, the user may encounter breathing difficulties. On the other hand, if the cover is being placed on the user's head in darkness, it is desirable to provide the user with a means to determine the location of the front of the cover. Accordingly in a preferred embodiment, "V" shaped notch 12 is provided in sheet 10 as illustrated in the Figs. Alternatively, a distinguishing color, decals or a patch of rough material which can be detected in the dark by feel can also be used.

If desired, the "V" shaped notch or other front distinguishing means may be eliminated.

The disposable cover is intended to be worn on the body as shown in FIGS. 2–4. In FIG. 2 the cover completely, but loosely covers the wearer's head and drapes down over the neck and shoulders. As can be seen, the covers shown in FIGS. 3 and 4 also loosely cover the portions of the body in a similar manner to that shown in FIG. 2.

The cover will normally be held in position on the user's head by a continuous, endless elastic band 20 capable of retaining the cover in position. A continuous elastic band 20 dimensioned to be positioned and sufficiently tensioned about the user's head is illustrated. The band can be provided in a "one size fits all" mode, or separate, individual sizes may be supplied. However, other fasteners such as hair clips or bobby pins may also be used. Alternatively, a tie string or other ribbon-type elongated tie string may be provided.

In FIG. 5, still another head band 22 is shown which may be tied utilizing separable fasteners such as Velcro brand fasteners 24 of the hook and loop-type, marketed by Velcro Corporation, Manchester, N.H. Such separable fastener band may be readily attached about the head of the wearer with selected tension to secure the cover in position, and it may be readily removed by peeling action on the separable fastener Further, such band may be fashioned to have an attractive decorative appearance while providing a substantially infinite variation of sizes.

The disposable body cover resembles an arabian style Kaffayah to a certain extent. However, in the case of the Arabian Kaffayah, the material is normally a thick white fabric which is intended to repel the sun and is normally open in the face area. The present disposable body cover extends over the face and is constructed of a substantially water impermeable material being transparent over at least the area corresponding to the lines of sight of the user.

The disposable cover can be made according to a number of different construction's. For example, a construction such as the small size as shown in FIG. 2 extends over the head and shoulder area of the user. A second size as shown in FIG. 3, extends over the head, the shoulders and upper portion of the body. The third size as shown in FIG. 4, extends substantially over the entire body. In each case, the frontal area adjacent the face is perforated as described above. Also, in each case, the elastic band 20 is if sufficient elasticity to retain the cover on the head without excessive tension being placed on the user's head In addition, for use over very short time periods, a cover which extends over the head alone can be constructed without the perforations 14, and without a distinguishing mark in the front. In such case, there will normally be adequate ventilation to the user since air will be free to pass under the lower extremity of the cover close to the user's face.

Referring now to FIG. 6 there is shown an alternative embodiment of the invention, wherein the cover 10 is positioned about the head and the neck of the user and a retaining band 26 is placed loosely about the sheet 10 and the neck of the user to retain the cover in position thereon. Apertures 14 are shown in the front of the user's face area for breathing. The band 26 may be endless and dimensioned to be slipped loosely about the sheet 10 and the user's neck. Alternatively, the band may be a ribbon-type band adapted to have both end portions tied into a bow or other tying arrangement. In either case the band should be sufficiently loose to avoid interference with the user's breathing.

Referring now to FIG. 7 there is illustrated another alternative embodiment which incorporates a decal 24 to assist the user in identifying the front of the disposable cover 10. Still another alternative embodiment is shown in FIG. 8 which incorporates a rough patch of material 26 on the front of the cover 10 to facilitate identification of the front of cover 10 by touch and feel.

When utilizing the present invention, during a rainstorm the user will avoid getting wet and yet, the hands will be free to move about. With the embodiment shown in FIGS. 3 and 4 the user does not have to use an umbrella and the user's packages or any other objects being carried will also avoid the rain. The user's hands will therefore be free to carry packages or objects in a less awkward manner as compared to the inconvenience of carrying an umbrella. The user will also be in a less awkward position to maneuver on public passes and to pass various obstructions in public in a manner not normally possible while carrying an umbrella in the hand. When the user arrives at the destination, the cover may be discarded. Thus the need to hold an umbrella or to keep a wet umbrella or raincoat in the home or office can now be avoided.

The disposable cover can be made in a "one size fits all" arrangement or it can be provided in different size groups such as adult sizes small, medium and large or children's sizes small, medium and large.

Furthermore, the disposable cover can be marketed in the same fashion as a small package of tissues or the like with one or more elastic head bands (or other fastener) provided per package. Such package would be compact and portable, therefore making it convenient for the end user.

The cover may be used as a make-up protector or rain gear promotional gift provided by department stores; and in lieu of or with a shower cap to protect make-up with the retaining band placed around the head as shown in FIGS. 1–4, or placed loosely around the neck as shown in FIG. 6.

I claim:

1. A disposable body protective garment which comprises a unitary sheet of polymeric water impermeable material having a continuous and uninterrupted periphery substantially over the entire extent thereof, and dimensioned and configured to be draped over a wearer's head, said material being tranparent at least over a portion corresponding to the lines of sight of the wearer when positioned thereon, and an annular elastic member dimensioned and adapted to encircle said sheet of material and an adjacent body portion of the wearer positioned thereunder to retain said sheet of water impermeable material in position on the body portion of the wearer.

2. The disposable body protective garment according to claim 1 wherein said unitary sheet of polymer water impermeable material has a circulat periphery substantially over the entire extent thereof.

3. A disposable body protective garment which comprises a unitary sheet of polymeric substantially water impermeable material having a continuous and uninterrupted periphery substantially over the entire extent thereof, and dimensioned and configured to be draped over a wearer's head, said material being tranasprent at least over a portion corresponding to the lines of sight of the wearer when positioned thereon, and an annular elasic member dimensioned and adapted to encircle and to be tensioned about said sheet of material and an adjacent portion of the wearer's head positioned thereunder to retain said sheet of water impermeable material in position on the wearer's head.

4. The disposable body protective garment according to claim 2 wherein said retaining means is ribbon-type tie having two portions capable of being loosely tied about said sheet of material and the wearer's neck, yet sufficiently snug to retain said sheet of material thereon without interfering with the wearer's breathing.

5. A disposable cover for protecting an upper portion of the human body which comprises:

(a) a unitary sheet of substantially water impermeable polymeric material having a continuous and uninterrupted periphery substantially over the entire extent thereof, and having a plurality of apertures selectively positioned such that when said sheet is positioned over the wearer's head, said apertures assist in providing ventilation for respiration of the wearer, said sheet being transparent at least in selected areas corresponding to lines of sight of the wearer sufficient to provide visibility to the wearer; and (b) elastic means positionable about said sheet of material and an adjacent portion of the wearer's head positioned thereunder for securely retaining said cover in position on the wearer's head.

6. The cover according to claim 5 wherein said polymeric material is a transparent flexible plastic material.

7. The cover according to claim 6 wherein said plastic material is polyethylene or polyvinylchloride.

8. The cover according to claim 7 wherein said retaining means is dimensioned to be positioned about the head of the wearer.

9. The cover according to claim 8 wherein said sheet material is disposable.

10. The cover according to claim 9 wherein said retaining means is an endless elastic band dimensioned to be positioned and tensioned about said sheet and the head of the wearer or slipped loosely around the neck to retain said sheet in position.

11. The cover according to claim 10 whereins aid retaining means is a separable fastener of the hook and loop type.

12. The cover according to claim 11 wherein said retaining means is a ribbon-type tie having two end portions capable of being tied about said sheet of material and the head of the wearer to retain said sheet of material thereon.

13. The cover according to claim 6 wherein the thickness of said plastic material ranges from about 0.3 mil to about 10 mil and preferably from about 0.5 mil to 1 mil.

14. The cover according to claim 5 wherein said sheet is dimensioned and configured to extend over the wearer's head and shoulder area.

15. The cover according to claim 5 wherein said sheet is dimensioned and configured to extend over the wearer's head, shoulders and upper body portion.

16. The cover according to claim 5 wherein said sheet is dimensioned and configured to extend over the wearer's body.

17. The disposable cover for protecting an upper portion of the human body according to claim 5 wherein said unitary sheet of substantially water impermeable polymeric material has a circular periphery substantially over the entire extent thereof.

18. A disposable rain protective garment which comprises:

(a) a unitary sheet of polymeric substantially water impermeable material having a continuous and uninterrupted periphery substantially over the entire extent thereof, and dimensioned to be draped over the head of a wearer so as to cover at least the head portion of the wearer, said material having a plurality of apertures selectively positioned such that when said sheet material is positioned over the wearer's head, said apertures assist in providing ventilation for respiration of the wearer, said shet material being transparent at least in selected areas corresponding to lines of sight of the wearer sufficient to provide normal visibility to the wearer;

(b) an elastic annular member positionable in predetermined tension about said sheet of material and the portion of the head of the wearer positioned thereunder sufficient to retain said sheet in position on the wearer's head; and (c) means to distinguish the front of said sheet material to facilitate alignment of said apertures with the lines of sight of the wearer.

19. The disposable rain protective garment according to claim 18 wherein said means to distinguish the front of said sheet material is a "V" shaped notch provided in said sheet material at a preselected loation.

20. The disposable rain protective garment according to claim 18 wherein said means to distinguish the front of said sheet material is a decal provided on said sheet material at a preselected location.

21. The disposable rain protective garment according to claim 18 wherein said means to distinguish the front of said sheet material is a patch of material provided on said sheet material at a preselected location, said patch having a surface sufficiently rough to assist the user to determine the front of said sheet material by touch and feel.

22. The disposable rain garment according to claim 18 wherein said unitary sheet of polymeric substantially water impermeable material has a circular periphery substantially over the entire extent thereof.

23. A disposable body protective garment which comprises a unitary sheet of polymeric water impermeable material having a continuous and uninterrupted periphery substantially over the entire extent thereof, and dimensioned and configured to be draped over a wearer's head, said material being transparent at least over a portion corresponding to the lines of sight of the wearer, and a member dimensioned and adapted to encircle said sheet of material and a portion of the wearer's neck positioned thereunder said member being adapted to be tensioned sufficient to retain said sheet of water impermeable material in position about the head and said portion of the neck of the wearer positioned thereunder but sufficiently loose to avoid interfering with the wearer's breathing.

24. A disposable body protective garment which comprises a unitary sheet of polymeric water impermeable material having a continuous and uninterrupted periphery over the entire extent thereof, and dimensioned and configured to be draped over a wearer's head, said material being transparent at least over a portion corresponding to the lines of sight of the wearer when positioned thereon, and an annular elastic member dimensioned and adapted to encircle said sheet of material and an adjacent portion of the wearer's head positioned thereunder to retain said sheet of water impermeable material in position on the head of the wearer.

25. A disposable body protective garment which comprises a unitary sheet of polymeric substantially water impermeable material having a continuous and uninterrupted periphery over the entire extent thereof, and dimensioned and configured to be draped over a wearer's head, said material being transparent at least over a portion corresponding to the lines of sight of the wearer when positioned thereon, and an annular elastic member dimensioned and adapted to encircle and to be tensioned about said sheet of material and an adjacent portion of the weare's head positioned thereunder to retain said sheet of water impermeable material in position on the wearer's head.

26. A disposable cover for protecting an upper portion of the human body which comprises:

(a) a unitary sheet of substantially water impermeable polymeric material having a continuous and uninterrupted periphery over the entire extent thereof, and having a pluraity of apertures selectively positioned such that when said sheet is positioned over the wearer's head, said apertures assist in providing ventilation for respiration of the wearer, said sheet being transparent at least in selected areas corresponding to lines of sight of the wearer sufficient to provide visibility to the wearer; and (b) elastic means positionable about said sheet of material and an adjacent portion of the wearer's head positioned thereunder for securely retaining said cover in position on the wearer's head.

27. A disposable rain protective garment which comprises:

(a) a unitary sheet of polymeric substantially water impermable material having a continuous and uninterrupted periphery over the entire extent thereof, and dimensioned to be draped over the head of a wearer so as to cover at least the head portion of the wearer, said material having a plurality of apertures selectively positioned such that when said sheet material is positioned over the wearer's head, said apertures assist in providing ventilation for respiration of the wearer, said sheet material being transparent at least in selected areas corresponding to lines of sight of the wearer sufficient to provide normal visibility to the wearer;

(b) an elastic annular member positionable in predetermined tension about said sheet of material and the portion of the head of the wearer positioned thereunder sufficient to retain said sheet of material in position on the wearer's head; and (c) means to distinguish the front of said sheet material to facilitate alignment of said apertures with the lines of sight of the wearer.

28. A disposable body protective garment which comprises a unitary sheet of polymeric water impermeable material having continuous and uninterrupted periphery over the entire extent thereof, and dimensioned and configured to be draped over a wearer's head, said sheet of material being transparent at least over a portion corresponding to the lines of sight of the wearer when positioned thereon, and a member dimensioned and adapted to encircle said sheet of material and a portion of the wearer's neck positioned thereunder said member being adapted to be tensioned sufficient to retain said sheet of water impermeable material in position about the head and said portion of the neck of the wearer positioned thereunder, but sufficiently loose to avoid interfering with the wearer's breathing.

* * * * *